US006640600B2

(12) United States Patent
Meinert

(10) Patent No.: US 6,640,600 B2
(45) Date of Patent: Nov. 4, 2003

(54) BENDING DEVICE

(75) Inventor: Dieter Meinert, Pforzheim (DE)

(73) Assignee: Paul Weinbrenner Maschinenfabrik GmbH & Co. KG, Weil der Stadt (DE)

( * ) Notice: Subject to any disclaimer, the term of this patent is extended or adjusted under 35 U.S.C. 154(b) by 0 days.

(21) Appl. No.: 09/837,873

(22) Filed: Apr. 18, 2001

(65) Prior Publication Data

US 2002/0059819 A1 May 23, 2002

(51) Int. Cl.[7] ..... B21D 5/04
(52) U.S. Cl. ..... 72/306; 72/311; 72/323
(58) Field of Search ..... 72/304, 386, 319, 72/311, 306, 322, 323, 308, 310

(56) References Cited

U.S. PATENT DOCUMENTS

| | | | | | |
|---|---|---|---|---|---|
| 759,217 | A | * | 5/1904 | Holden | 72/319 |
| 858,514 | A | * | 7/1907 | Huff | 72/322 |
| 2,217,378 | A | * | 10/1940 | Nilsby | 72/319 |
| 2,438,319 | A | * | 3/1948 | Kilham | 72/319 |
| 3,028,628 | A | * | 4/1962 | Rutherford | 72/379.2 |
| 3,359,771 | A | * | 12/1967 | Meyerchick | 72/319 |
| 5,105,640 | A | * | 4/1992 | Moore | 72/306 |
| 6,324,882 | B1 | * | 12/2001 | Kutschker et al. | 72/319 |

FOREIGN PATENT DOCUMENTS

| | | | | |
|---|---|---|---|---|
| DE | 36 05 815 | | 6/1995 | |
| DE | 37 09 018 | | 3/1996 | |
| FR | 1279518 | * | 11/1961 | 72/311 |
| SE | 108325 | * | 8/1943 | 72/319 |

* cited by examiner

*Primary Examiner*—Daniel C. Crane
(74) *Attorney, Agent, or Firm*—Gudrun E. Huckett

(57) ABSTRACT

A bending device has one or more bending tools and each bending tool has one or more adjustable bending jaws and one or more stationary bending jaws for producing a fold on a sheet metal plate. The adjustable bending jaw is pivotably supported on the stationary bending jaw so as to be pivotable about a pivot axis. The adjustable and stationary bending jaws have end faces and bending strips arranged in the area of the end faces. The bending strips in an initial position of the adjustable and stationary bending jaws delimit an opening angle having a bisecting line intercepting the pivot axis. At least one joint connects the adjustable bending jaw and the stationary bending jaw to one another. At least one adjusting device engages the adjustable bending jaw and is supported on the stationary bending jaw for adjusting the adjustable bending jaw.

22 Claims, 14 Drawing Sheets

Fig.12
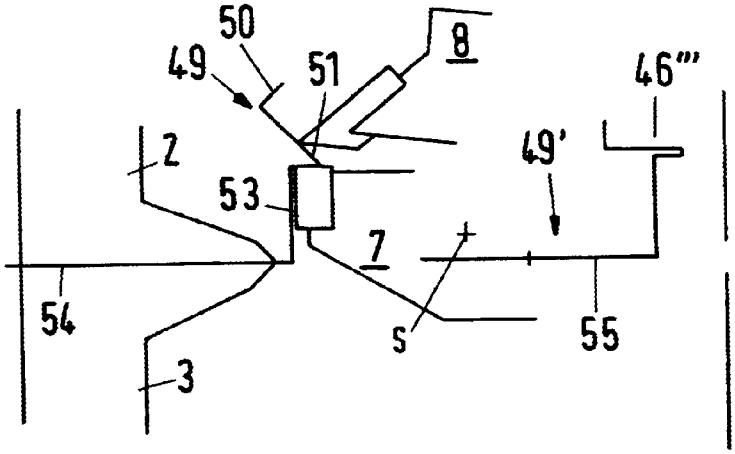
Fig.12a
Fig.12b
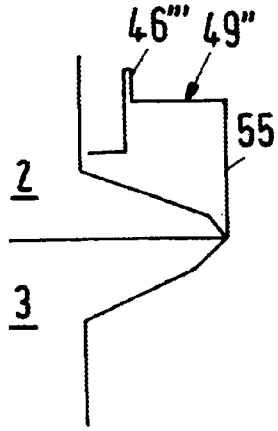
Fig.13
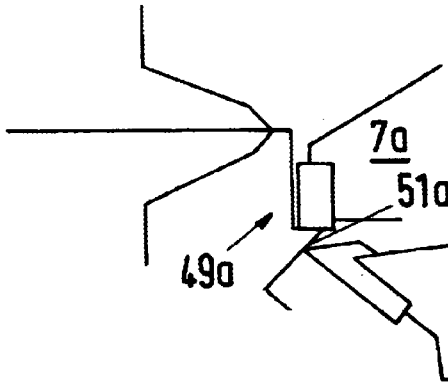
Fig.13a
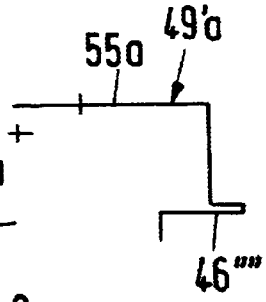
Fig.13b
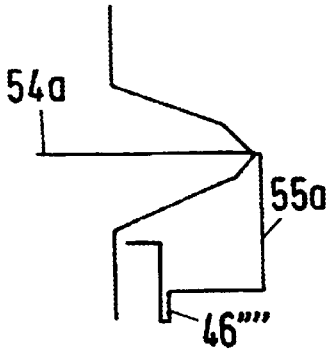

BENDING DEVICE

BACKGROUND OF THE INVENTION

1. Field of the Invention

The invention relates to a bending device comprising a bending tool having at least one adjustable bending jaw.

2. Description of the Related Art

Bending devices configured as bending machines are known in which sheet metal can be bent. These bending machines have a bending tool with upper and lower bending bars. The sheet metal is clamped between oppositely positioned clamping tools. An edge portion of the sheet metal projecting past the clamping tools can be bent by a bending bar which is moved against the sheet metal from above or below. When it is desired to form a fold in the sheet metal at a spacing from its edge, this fold must be formed in a cumbersome way.

SUMMARY OF THE INVENTION

It is an object of the invention to configure a device of the aforementioned kind such that folds, which are positioned at a spacing from the edge of the sheet metal part, can be produced by the device on sheet metal parts in a simple, inexpensive way.

This object is solved according to the invention by a bending device of the aforementioned kind in that the adjustable bending jaw is pivotably supported on a stationary bending jaw for producing a fold on a sheet metal plate.

The bending device according to the invention can be connected to conventional bending machines or can be used independently therefrom. The bending part or the sheet metal plate can first be bent in the bending machine. Subsequently, a pre-bent sheet metal portion is positioned between the two bending jaws. By pivoting one of the bending jaws, two legs of the pre-bent sheet metal portion are pressed between the bending jaws so that the fold is formed. It can be produced at a spacing from the edge of the sheet metal part by a simple pivot action of one of the bending jaws.

Further features of the invention can be taken from the further claims, the description, and the drawings.

BRIEF DESCRIPTION OF THE DRAWINGS

The invention will be explained in more detail in the following with the aid of several embodiments illustrated in the drawing. It is shown in:

FIG. 6*a* in a perspective and simplified illustration the pivotable connection between the upper and lower bending jaws according to the device of the present invention.

FIG. 12 in a schematic illustration a further bending process corresponding to FIG. 9;

FIG. 12*a* the sheet metal part bent according to the bending process of FIG. 12;

FIG. 12*b* the sheet metal according to FIG. 12*a* which has been bent again with a known bending machine;

FIG. 13, FIG. 13*a,* and FIG. 13*b* illustrations according to FIGS. 12, 12*a* and 12*b* but employing the device according to FIG. 3;

DESCRIPTION OF PREFERRED EMBODIMENTS

Figure 1:
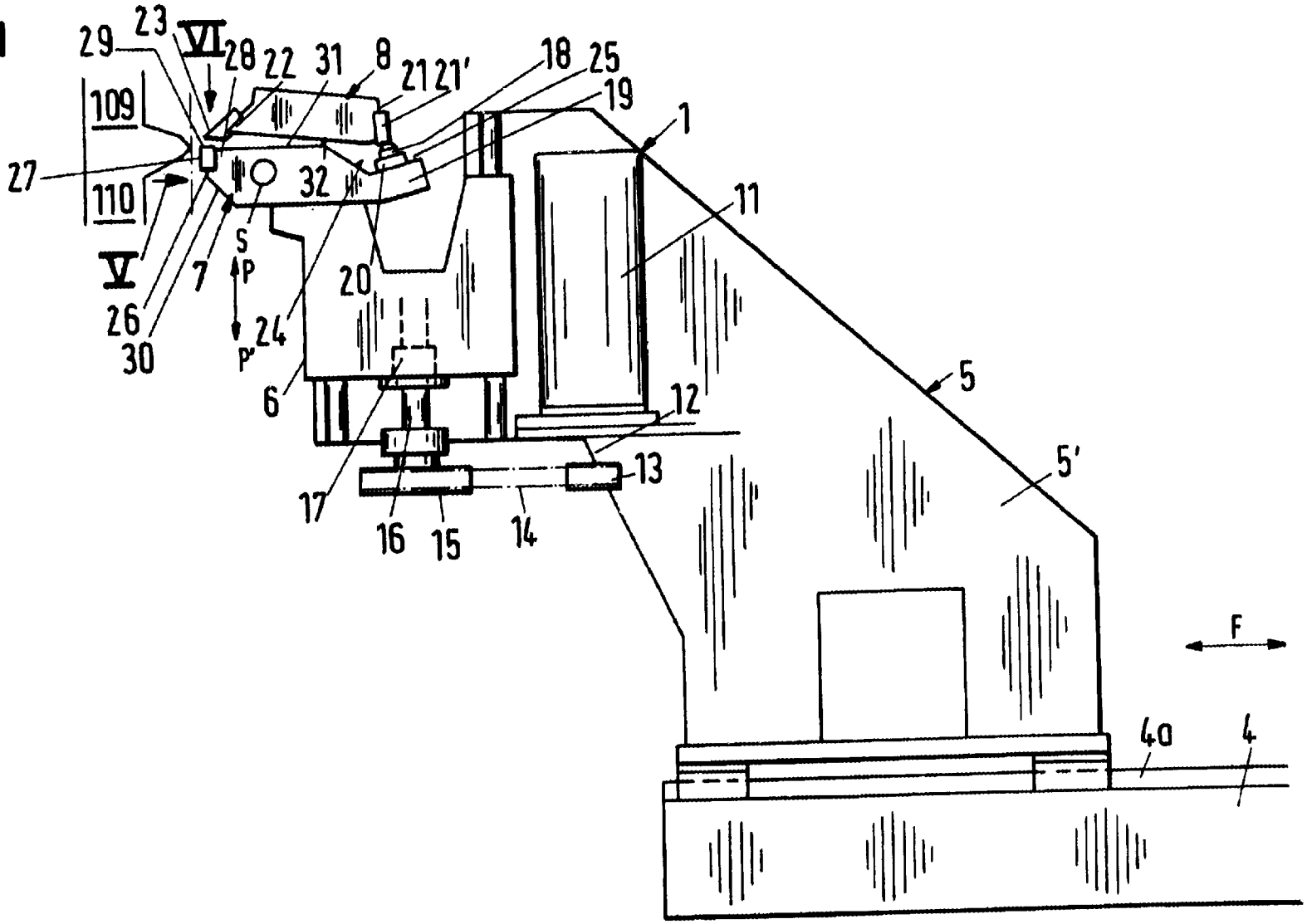
FIG. 1 in a schematic illustration a bending device according to the invention with bending jaws arranged on a carriage which bending device is positioned adjacent to a bending machine that is only schematically indicated.

The bending device illustrated in FIG. 1 is provided on a bending machine (FIG. 14) for bending sheet metal plates. In FIG. 1 only the upper and lower clamping tools 109, 110 of the bending machine are illustrated.

By means of the bending machine the edges of sheet metal plates can be bent in two different planes, for example, to a U-shape or a Z-shape. The bending machine according to FIGS. 14 to 18 has a stand 101 in which a clamping device 102 as well as a bending unit 103 are arranged. The bending machine has moreover a switching and control center 104 with a securing and adjusting device 105 with which the sheet metal plate 106 (FIG. 15) to be machined is brought into the desired position relative to the bending unit 103 on a machining plane E of a table (not illustrated) or another support.

The clamping device 102 has two clamping rockers 107 arranged at a spacing to one another at the same level which are supported on the stand so as to be pivotable about a common horizontal axis 108 and between which an upper clamping tool 109 is fastened. It is moved during pivoting of the clamping rockers 107 on a circular arc about the pivot axis 108. For clamping the sheet metal plate 106, the clamping rockers 107 are pivoted downwardly into the illustrated position in a clockwise direction so that the upper clamping tool 109 is pivoted downwardly from the initial position illustrated in dashed lines in FIG. 14 into the clamping position illustrated with solid lines until, with intermediate positioning of the sheet metal plate 106, it rests on a lower clamping tool 110. Accordingly, the sheet metal plate is properly held down in the desired position so that its projecting edge portion 111 (FIG. 15) facing the bending unit 103 can be machined by the bending unit.

It has a lower bending tool and an upper bending tool 112 and 113 which are pivotably connected to a support 114. The support 114 is formed by two rockers positioned adjacent and at a spacing to one another at the same level and fastened on the same axis 115 wherein in the drawings only one rocker is illustrated. Between the rockers the bending tools 112, 113 extend across the entire length of the edge to be machined. The rockers have approximately a triangular shape and are arranged, viewed in the direction of axis 115, in a congruent arrangement. Their longitudinal edges 116, 117 diverge in a direction toward the control center 104 and have a transition in the form of a rounded tip 118 into one another at their end facing away from the control center. The pivot axis 115 is positioned in the area of the tip 118 while the pivot axes 119, 120 of the bending tools 112, 113 are positioned at the oppositely located end of the rockers in the area of the corners 121, 122 which are delimited by the longitudinal edges 116, 117 and a narrow side 123 positioned opposite the tip 118. The rockers moreover are arranged such that their pivot axis 115 is positioned within the machining plane E of the bending machine. The pivot axes 119, 120 are positioned on a circular arc about the pivot axis 115 of the rockers or the support 114.

The bending tools 112, 113 have correlated therewith two, preferably hydraulic, pivot drives (not illustrated) which are preferably arranged at the outer sides of the rockers facing away from one another.

For adjustment to the respective sheet metal thickness of the sheet metal plate to be machined and to the bending radius with which the respective edge of the sheet metal plate is to be bent, the bending tools can be adjusted manually or motor-driven in the height direction relative to the rockers.

Figure 14:
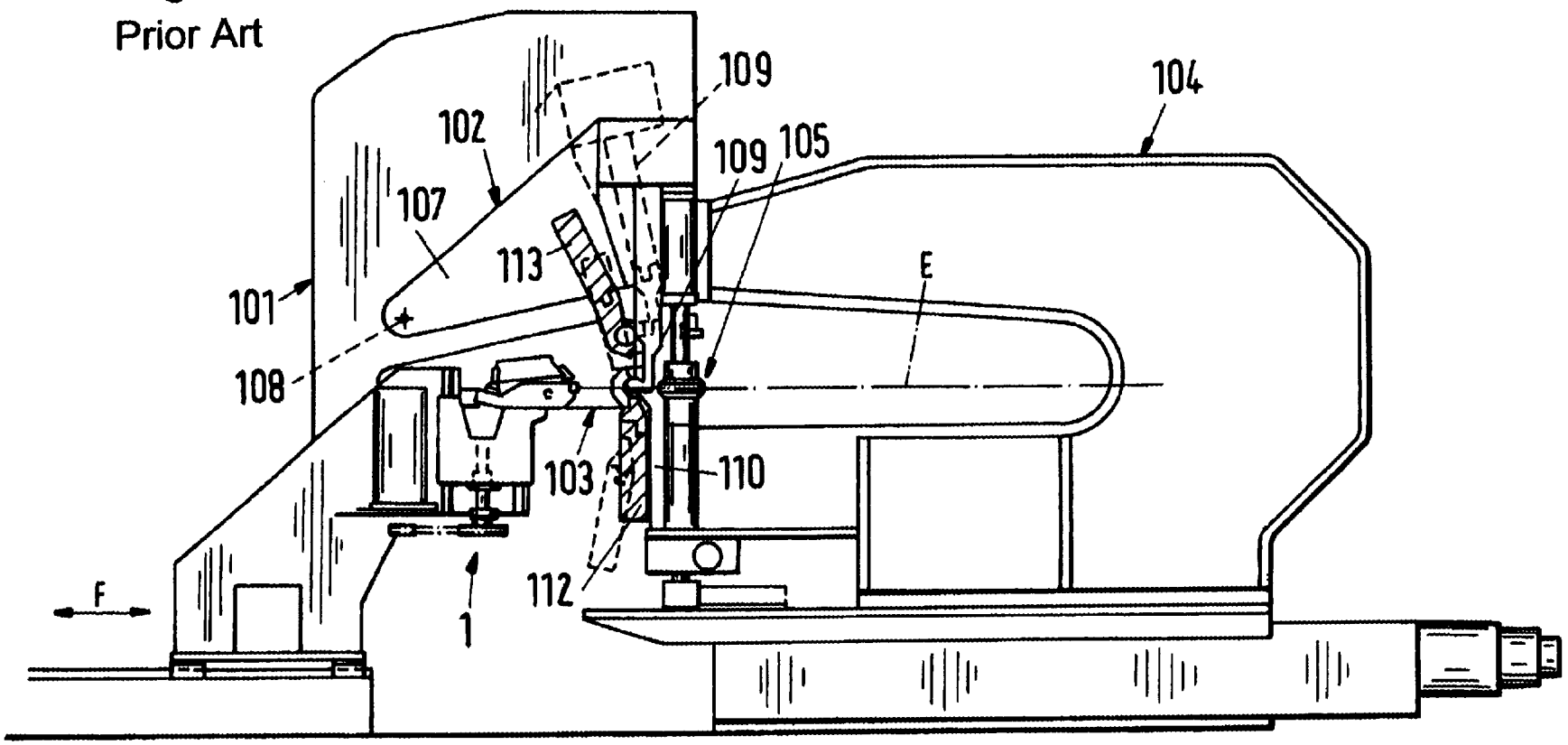
Fig.14 Prior Art
FIG. 14 partially in vertical section and partially in an end view a bending machine for bending edges of a sheet metal plate with a bending device according to the invention.
Figure 15:
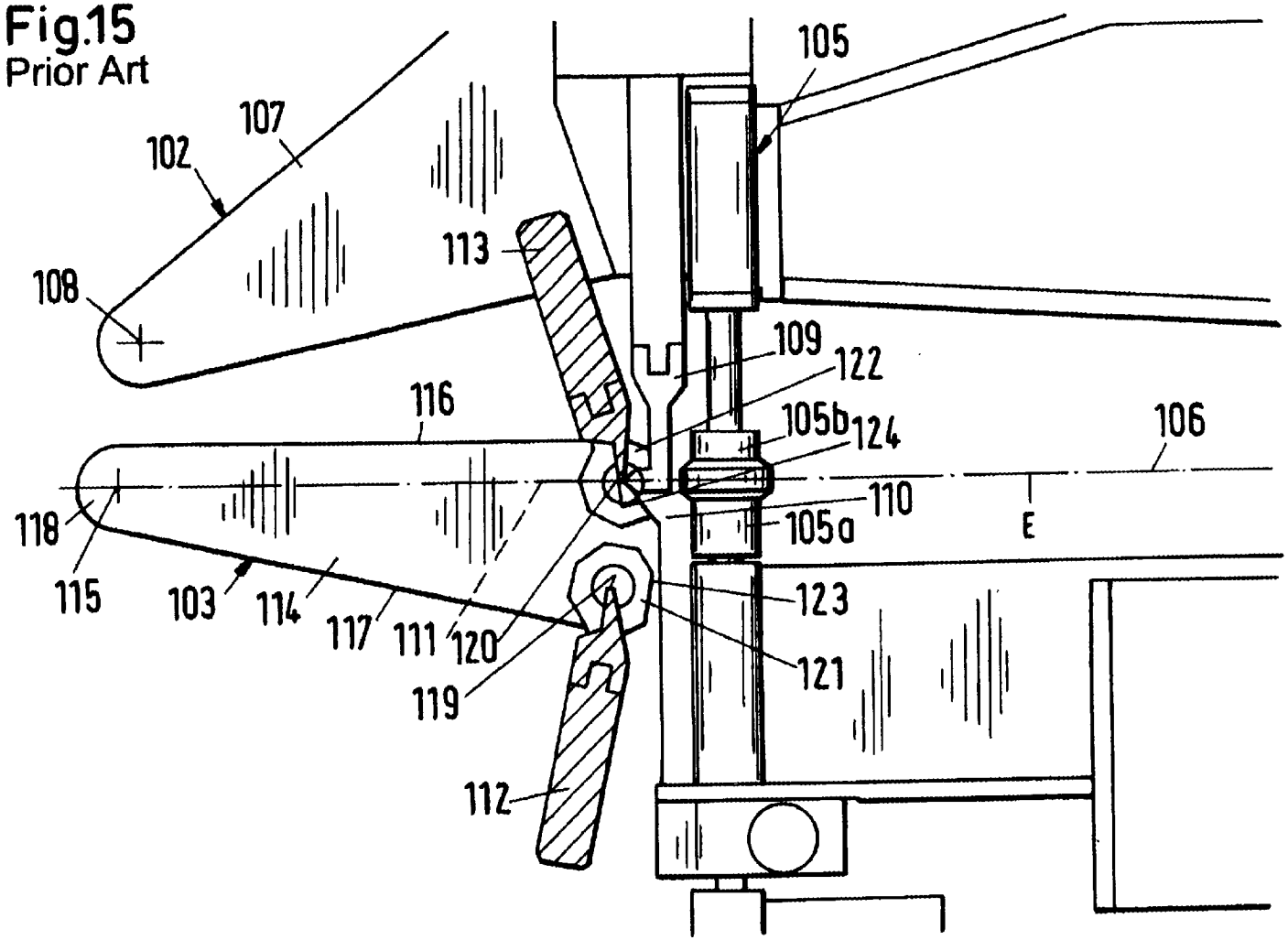
Fig.15 Prior Art
FIG. 15 in an enlarged illustration a part of the bending machine according to FIG. 14 without bending device with upper and lower clamping tools as well as upper and lower bending tools, wherein the lower bending tool is in its initial position.

For bending or folding the edge portion 111, the sheet metal plate 106 is first moved by means of the securing and adjusting device 105 in the working plane E into the position illustrated in FIG. 15 in which the sheet metal plate is clamped between upper and lower disks 105*a*, 105*b* of the securing and adjusting device 105. Subsequently, the upper clamping tool 109, by downwardly pivoting the clamping rocker 107 in the clockwise direction, is pivoted from the position illustrated in dashed lines in FIG. 14 into the position according to FIG. 15 wherein the sheet metal plate 106 is clamped directly behind the edge portion 111 to be machined between the clamping tools 109 and 110 and is held down by the upper clamping tool 109.

Subsequently, the support 114 is pivoted from the position illustrated in FIG. 14, in which it is upwardly pivoted in a counter-clockwise direction into an upper stop position and in which its lower longitudinal edge 117 extends parallel to the working plane E and the upper bending tool 113 is above the working plane, about the axis 115 in the clockwise direction downwardly into the position illustrated in FIG. 15. In this position the upper bending tool 113 rests with a free bending edge 124 on the edge portion 111 of the sheet metal plate 106. The upper longitudinal edge 116 of the rocker 114 extends parallel above the machining plane E.

Figure 16:
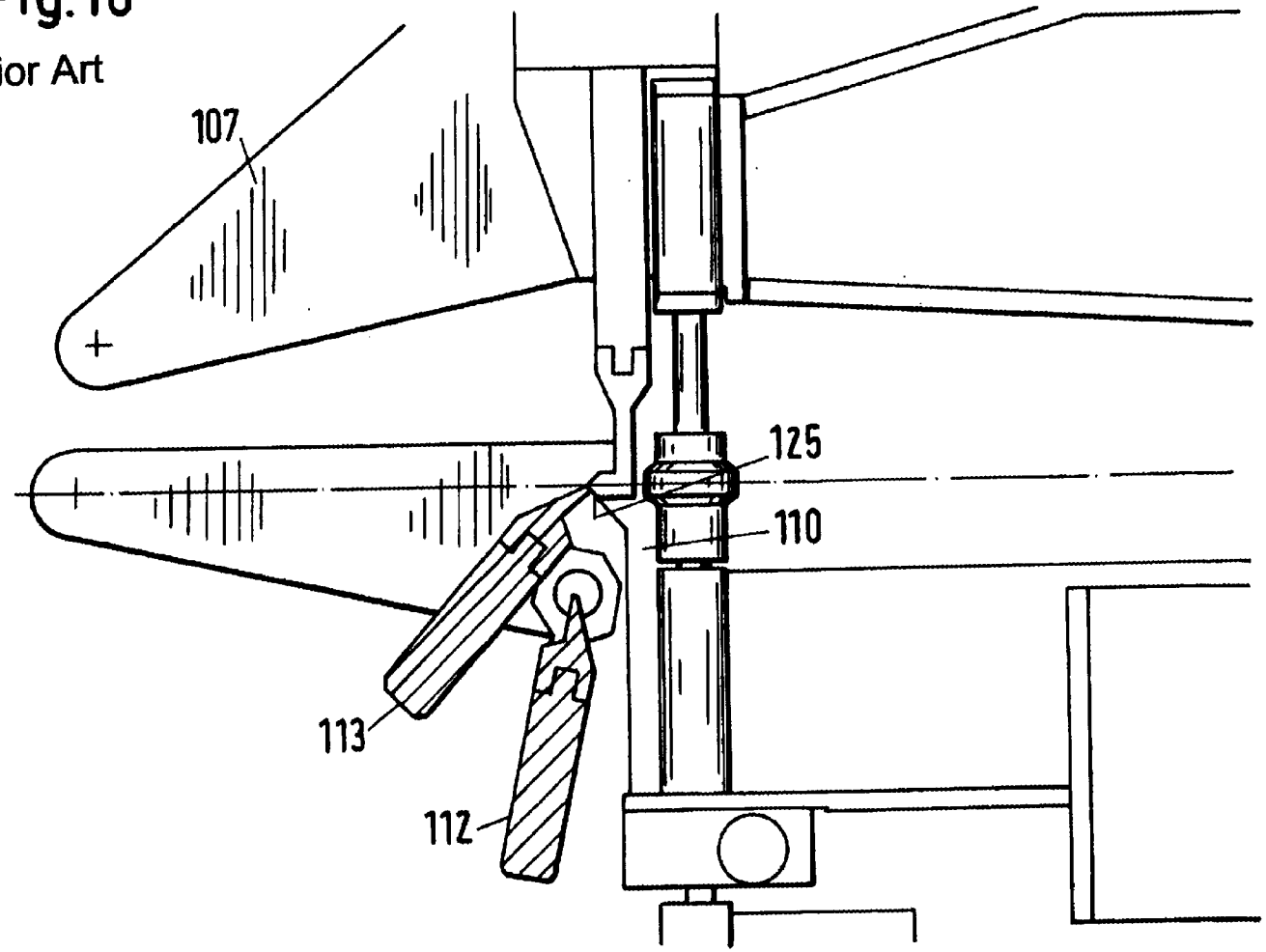
Fig.16 Prior Art
FIG. 16 an illustration corresponding to FIG. 15 with the upper bending tool in a downwardly pivoted working position.
Figure 17:
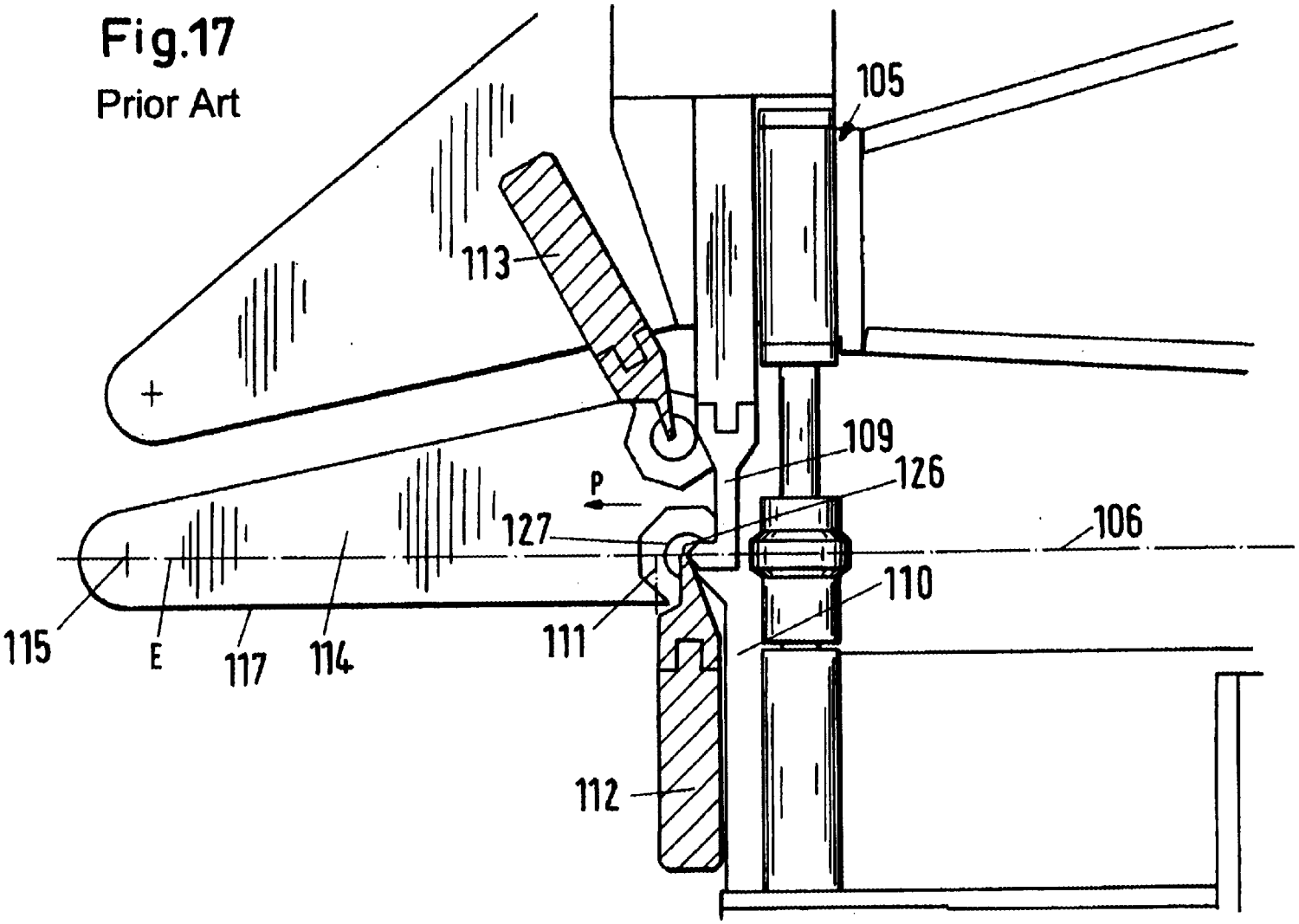
Fig.17 Prior Art
FIG. 17 an illustration according to FIG. 15 with the lower bending tool in an initial position.

As illustrated in FIG. 15, in this ready position of the upper bending tool 113 the lower bending tool 112 is positioned with relatively large spacing below the sheet metal plate 106 outside of the pivot path of the upper bending tool. Now the upper bending tool 113 is pivoted downwardly about the desired pivot angle, which is up to at least 135°, in a counter-clockwise direction from its slantedly upwardly oriented ready position about the axis 120. In this connection, the edge portion 111 is bent about a forward longitudinal edge 125 of the lower clamping tool 110 in the downward direction (FIG. 16). The upper machining tool 113 is then pivoted back in the upward direction into its previous position in the clockwise direction and, expediently at the same time, the upper clamping tool 109 is lifted off the sheet metal plate 106 so that it can be moved forwardly by means of the securing and adjusting device 105 in the feed direction P (FIG. 17) until a further edge 127, to be bent subsequently upwardly, projects past the clamping tools 109, 110. The clamping tool 109 is then again lowered in order to hold down the sheet metal plate. Subsequently, the support 114 is pivoted in a counter-clockwise direction upwardly about the axis 115 into the initial position according to FIG. 14 or 17. In this position the lower bending tool 112 is in its ready position in which it rests with its free longitudinal edge 126 (FIG. 17) against the underside of the sheet metal plate 106. In this ready position the lower bending tool 112 extends vertically downwardly. The lower longitudinal edge 117 of the rocker or the support 114 extends then parallel and below the machining plane E.

Figure 18:
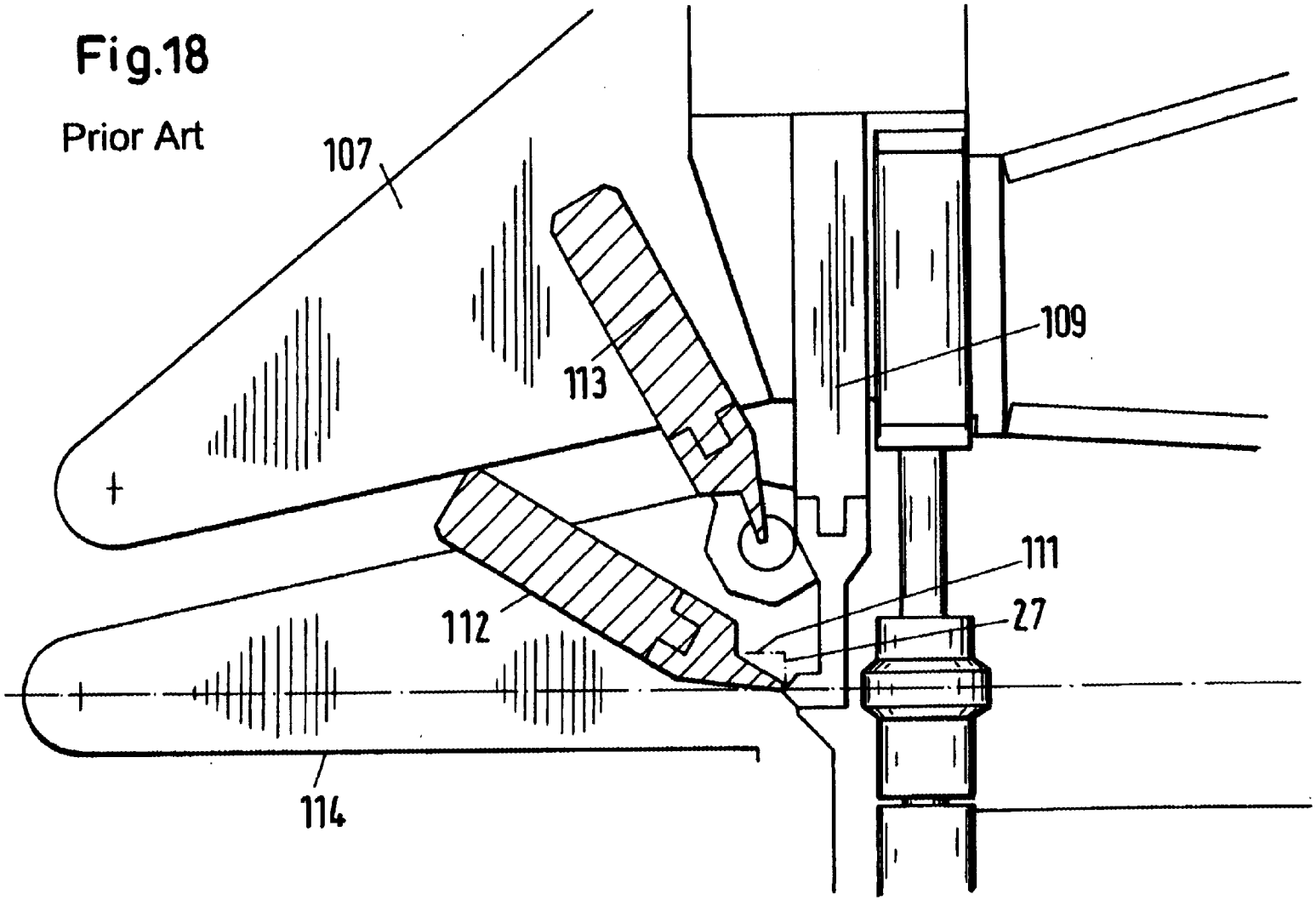
Fig.18 Prior Art
FIG. 18 an illustration corresponding to FIG. 17 with an upper bending tool pivoted into a working position.

The bending tool 112 is then pivoted about the desired pivot angle upwardly in the clockwise direction wherein the edge portion 127, like the edge 111, is upwardly bent, in the embodiment by 90°, by a folding process. This results in a Z-shaped edge 111, 127 (FIG. 18).

For removing or rotating the sheet metal plate 106, when, for example, another edge is to be bent accordingly, the bending tool 112 must again be pivoted downwardly into its ready position and the clamping tool 109 must be pivoted upwardly by pivoting the rockers 107.

The pivotable arrangement of the upper clamping tool 109 is primarily advantageous when a U-shaped edge is to be bent because it can be released from of the U-shaped edge without prior retraction by a mere pivoting of the clamping rockers 107.

Instead of rockers, the support 114 can have a height-adjustable carriage or vertically movable side parts that move together at both sides of the bending tools 112, 113.

With this bending machine, the edge of the sheet metal plate 106 is bent by a folding process. Accordingly, the sheet metal plate 106 can be machined with minimal apparatus expenditure and without causing friction on the sheet surface. Accordingly, damage of the sheet metal plate 106 is prevented. The pivot angle of the bending tools 112, 113 corresponds precisely to the bending angle of the respective sheet metal plate edge so that without special control-technological expenditure a precise bending of the sheet metal plate 106 is ensured. With the pivotable support 114 a simple and precise adjustment of the bending tools 112, 113 to the sheet metal thickness and to the bending radii of the edges of the sheet metal plate 106 is possible. With the pivotable support 114 the tool, which is not in use at the moment, can be pivoted in a simple way out of the pivot path of the other bending tool 112, 113 which is being used or of a holding-down tool 109, 110 of the clamping device 102. When pivoting the bending tool 112, 113 which is currently not in use, the other bending tool can be pivoted into its position of use in the same working step, so that the bending deformation can be carried out within a very short time in a very economical way.

Figure 19:
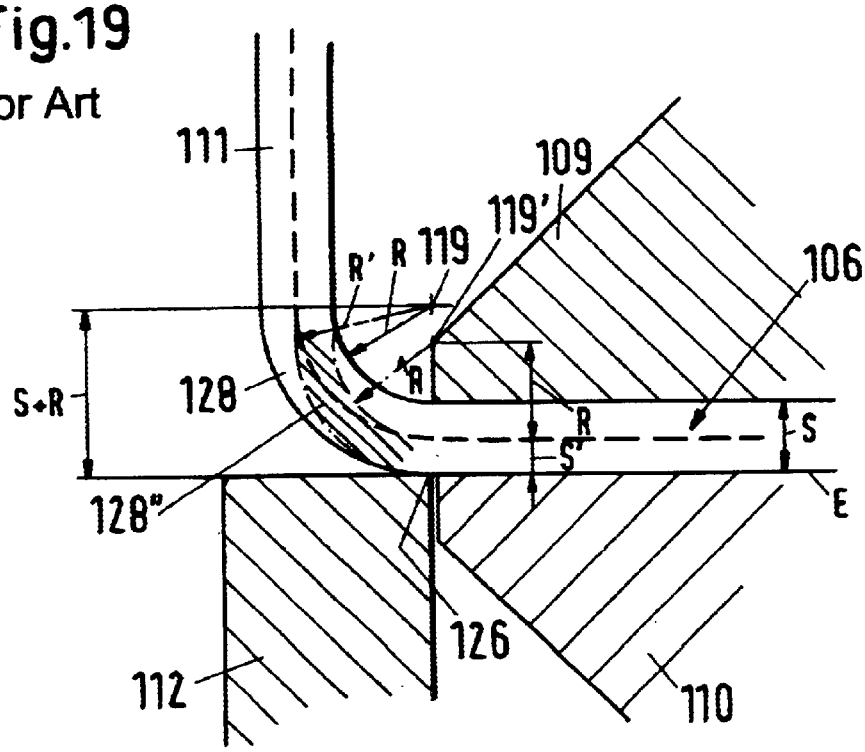
Fig.19 Prior Art
FIG. 19 in a schematic illustration a lower bending tool of a further embodiment of a bending machine as well as an end of a sheet metal plate bent upwardly by this bending tool.
Figure 20:
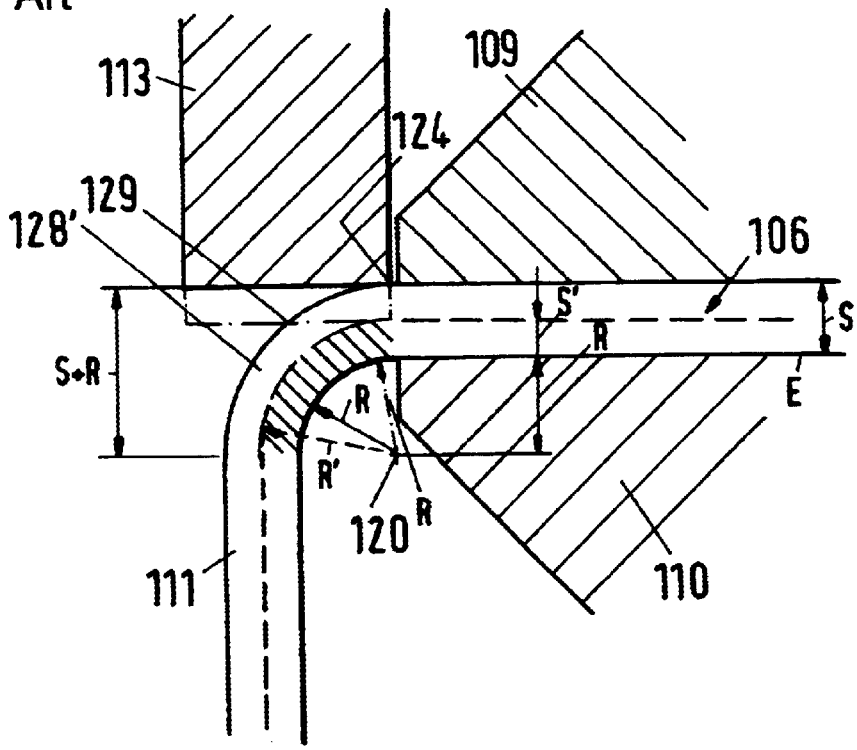
Fig.20 Prior Art
FIG. 20 in a schematic illustration an upper bending tool of the bending machine according to FIG. 19 as well as an end of the sheet metal plate bent downwardly by the bending tool.
Figure 22:
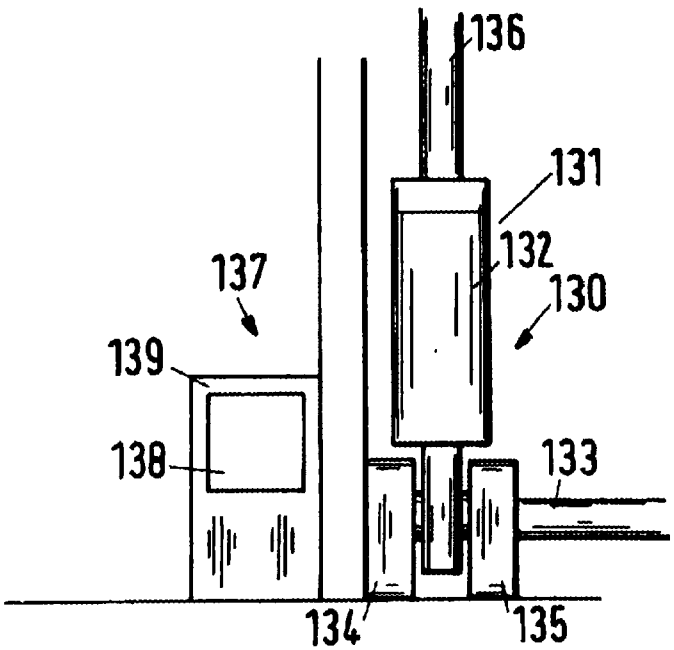
Fig.22 Prior Art
FIG. 22 in a schematic illustration the adjusting device according to FIG. 1 in a front view.
Figure 21:
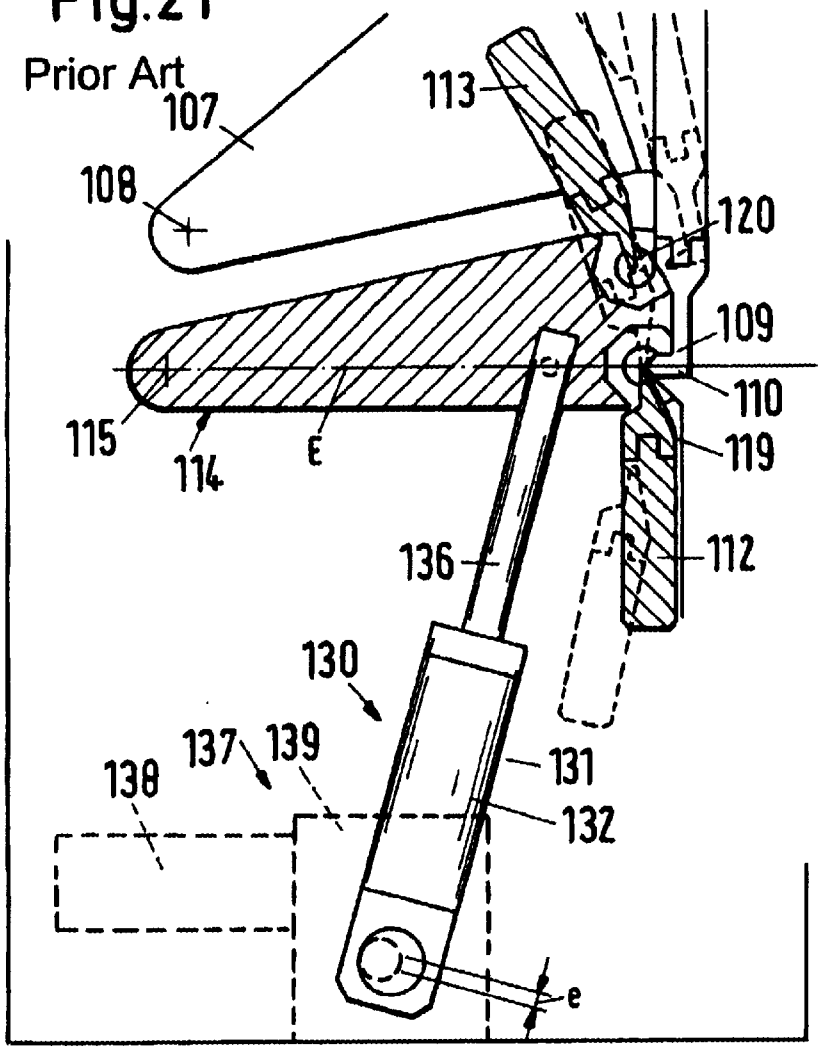
Fig.21 Prior Art
FIG. 21 in a schematic illustration and partially in section an adjusting device for adjusting the bending tools.

In the embodiment according to FIGS. 19 to 22, an adjusting device 130 (FIGS. 21 and 22) is used for pivoting the support 114. It has two piston-cylinder units 131 whose cylinders 132 are supported on an eccentric shaft 133 which is supported at its ends in two bearing blocks 134, 135, respectively. The piston rods 136 of the piston-cylinder units 131 are connected with their free end on the rockers of the support 114 at the end portion facing away from the pivot axis 115 (FIG. 21). Each piston-cylinder unit 131 is connected to a drive apparatus. By extending or retracting the piston rods 136, the rockers of the support 114 and thus the bending tools 112, 113 can be moved into the desired position. In order to make possible a problem-free adjustment, the cylinders 132 are pivotably supported between the bearings 134, 135 on the eccentric shaft 133.

The sheet metal plate 106 is bent by the lower bending tool 112 about a predetermined radius (FIG. 19). For a sheet metal thickness S, the bent sheet metal part 128 has a length S+R measured perpendicularly to the sheet metal plane.

When the edge portion 111 of the sheet metal plate 106 is to be bent downwardly by means of the upper bending tool 113, the rockers of the support 114 are pivoted by the adjusting device 130 about the axis 115 in the clockwise direction to such an extent that the bending edge 124 (FIG. 20) of the lower bending tool 113 comes to rest against the sheet metal plate 106. The lower bending tool 112 is positioned with relatively large spacing underneath the sheet metal plate 106 outside of the pivot path of the upper bending tool 113 which is pivoted about the desired angle in a counter-clockwise direction for bending the sheet metal plate about the axis 120. In this connection, the sheet metal plate 106 is bent downwardly with the radius of curvature R so that the bent sheet metal part 128' has a length S+R measured perpendicularly to the sheet metal plane.

For the bending tools 112, 113 two, preferably hydraulic, pivot drives (not illustrated) are provided which are preferably arranged at the outer sides of the rockers facing away from one another.

Frequently, sheet metal plates of different thicknesses must be bent with the same inner bending radius. In FIG. 19 the dashed line indicates the upper side facing the clamping tool 109 of a thinner sheet metal plate which has a thickness S'. When now for bending this thinner sheet metal plate 106 the lower bending tool 112 is pivoted in the clockwise direction about the same axis 119, the sheet metal plate has no longer the bending radius R but the larger bending radius R'.

When the upper bending tool 113 is pivoted about the axis 120 for bending the thinner sheet metal plate, the bending tool has first no contact with the thinner sheet metal plate clamped between the clamping tools 109 and 110. The bending tool 113 first contacts the sheet metal plate at the point 129. It is therefore bent with a greater inner bending radius R'.

When between the clamping tools 109, 110 a sheet metal plate is clamped whose thickness is greater than the thickness S, then the inner bending radius R is reduced when the position of the pivot axis 119 of the lower bending tool 112 remains unchanged. When the upper bending tool 113 is pivoted downwardly with unchanged position of the pivot axis 120, the thicker sheet metal plate will be sheared off already at the beginning of the pivot action by the upper bending tool 113.

For this reason, the pivot axes 119, 120 of the bending tool 112, 113 are adjustable so that even for sheet metal plates of different thicknesses the same inner bending radius R can be produced, respectively.

When between the clamping tools 109 and 110 the sheet metal plate 106 with the smaller thickness S' is clamped and with the lower bending tool 112 the same inner bending radius R is to be produced as in the case of the sheet metal plate 106 with the thickness 5, first the rockers of the support 114 are pivoted in the described way such that the bending tool 112 with its bending edge 126 rests against the underside of the sheet metal plate. Subsequently, the pivot axis 119 of the lower bending tool 112 is adjusted in the direction toward the sheet metal plate 106 to such an extent that its spacing from the working plane E is identical to R+S'. The new position of the pivot axis is shown in FIG. 19 at 119'. In order for the pivot axis 119 to be adjustable, the bending tool 12 is of a two-part configuration. One tool part is seated on the axle 119 while the tool part having the bending edge 126 is adjustable relative to the other tool part. By means of the adjusting device 130 the rockers of the support 114, as described above, are pivoted until the bending edge 126 of the lower bending tool 112 rests against the sheet metal plate of the thickness S'. Now the pivot axis 119 must be adjusted into the position 119' so that the thinner sheet metal plate can be bent with the inner bending radius R. For this purpose, the eccentric shaft 133 is rotated by the drive 137. In the embodiment, it has a motor 138 and a transmission 139, preferably a worm gear pair, with which the eccentric shaft 133 can be precisely rotated by the desired amount. By rotation of the eccentric shaft 133 the piston-cylinder units 131 are adjusted by the respective stroke e (FIG. 21). The maximum adjusting stroke is the eccentric length e (FIG. 21). With this adjustment the rockers of the support 114, and thus the pivot axis 119, are adjusted in a direction transverse to the working plane E, the direction depending on the rotational direction of the eccentric shaft 133. In the described way, the rockers of the support 114 are pivoted by rotation of the eccentric shaft 133 to such an extent that the pivot axis 119 reaches the position 119' (FIG. 19). Since upon this adjusting process the bending edge 126 is also adjusted downwardly and thus has a spacing from the sheet metal plate, the tool part with the bending edge 126 is adjusted relative to the other tool part having the pivot axis 119 to such an extent that the bending edge 126 rests again against the underside of the sheet metal plate. The bending tool 112 is pivoted about the pivot axis 119' and the sheet metal plate with the thickness S' is bent with the inner bending radius R. The thus resulting bent sheet metal part 128" having the same inner bending radius R as the sheet metal part 128 of the sheet metal plate of the thickness S is illustrated in FIG. 19 by cross-hatching.

When with the lower bending tool 112 a sheet metal plate with a greater thickness than the thickness S is bent, the eccentric shaft 133 is rotated in the other direction and the pivot axis 119 is thus adjusted such that its spacing from the working plane E is again the sum of the inner bending radius R and the sheet metal plate thickness.

In this way, by adjusting the pivot axis 119 it is possible to bend sheet metal plates of different thicknesses with the same inner bending radius R, respectively. The spacing of the pivot axis 119 from the working plane E, i.e., from the underside of the sheet metal plate, is adjusted such that this spacing corresponds to the sum of the inner bending radius R and the respective plate thickness.

When the sheet metal plate with the smaller thickness S' is to be bent by the upper bending tool 113, first the rockers of the support 114 are pivoted by means of the 20 adjusting device 130 about the axis 115 such that the bending edge 124 rests against of the thinner sheet metal plate (dash-dotted line in FIG. 20). The pivot axis 120 is pivoted also by this action because it is connected with the rockers of the support 114. In order to be able to obtain the inner bending radius R for the thinner sheet metal plate, the pivot axis 120 must be adjusted in the direction toward the working plane E relative to the bending edge 124. By means of the eccentric shaft 133 the rockers of the support 114 and thus the pivot axis 120 are adjusted in the described way until the pivot axis 120 has reached the position required for producing the inner bending radius R. With this adjusting, the bending edge 124 slightly lifts off the thinner sheet metal plate. The tool part which contains the bending edge 124 is therefore readjusted relative to the tool part containing the pivot axis 120 such that the bending edge 124 will again rest on the sheet metal plate.

The position of the pivot axis 119, after the described adjusting process, is identical with the position of the pivot axis when bending the sheet metal plate with the thickness S.

In FIG. 20, the position of the upper bending tool 113 is indicated by a dash-dotted line which the tool assumes for bending a sheet metal plate with the smaller thickness S'. The pivot axis 120 has the spacing R from the working plane E, respectively, a spacing from the bending edge 124 which corresponds to the sum of the inner bending radius R and the respective sheet metal thickness.

For the described adjustment of the pivot axes 119, 120 as well as for the pivoting of the bending tools 112, 113, other suitable adjusting means can also be employed. By means of the bending tools 112, 113, the edges of the sheet metal plate 106 can be bent to have a U-shape, a Z-shape, or another shape.

The bending device 1 to be used on a bending machine has a bed 4 with a guide 4*a* on which the support 5 of the bending device 1 is movable. The support 5 has two lateral jaws positioned at a spacing to one another of which in FIG. 1 only one jaw 5' is illustrated, the jaws being connected by a transverse beam which extends perpendicularly to the travel direction F of the support 5. At a spacing from the guide 4*a* a height adjustable carriage 6 is supported on the support 5 which is adjustable perpendicularly to the travel direction F by a motor drive. On it, two bending jaws 7, 8 of the bending tool are arranged with which a portion 9 (FIG. 4) of a sheet metal plate 41, bent at an obtuse angle or in a V-shape, is to be bent such that a fold (FIGS. 9 through 13 and FIGS. 9*a* through 13*a*) is formed wherein the two legs of the fold contact one another.

On the support 5 a motor 11 is arranged whose downwardly extending shaft 12 supports a gear or pulley 13 which is in driving connection by means of a chain or a belt 14 with a further gear or pulley 15. It is seated fixedly on the lower end of a vertical spindle 16 which is rotatably supported on the support 5 and on which a spindle nut 17 is seated. It is connected to the carriage 6. Instead of one adjusting drive it is also possible to employ two adjusting drives for height adjustment of the carriage 6 which are positioned close to the two jaws 5' of the support 5. By switching on the motor 11, the spindle 16 is rotated by means of the drive 12 to 15 so that via the spindle nut 17 the carriage 6, depending on the rotational direction of the spindle 6, is moved upwardly or downwardly in the direction of arrow P, P'.

The lower bending jaw 7 is fastened on the carriage 6 by the upper bending jaw 8 is pivotably supported on the lower bending jaw 7. The two bending jaws 7, 8 extend perpendicularly to the travel direction F and the adjusting direction P, P' in the area between the jaws 5' of the support 5. The upper bending jaw 8 is pivotable about an imaginary axis S which is positioned in the area below the bending area of the bending tool 7, 8. For pivoting the upper bending jaw 8, a pivot drive 20 is provided on the edge 21 facing away from the clamping tools 2, 3 of the bending machine 2, 3 with which the upper bending jaw 8 can be pivoted about the axis S from the initial position illustrated in FIG. 1 against the lower bending jaw 7 for producing a fold.

The pivot drive is supported on a projection 19 of the lower bending jaw 7 and has along the projection 19 hydraulic or pressure cylinders 20 (FIG. 6) which are arranged at a spacing to one another and whose pistons 18 are connected to the longitudinal support 21 of the bending jaw 8. For connecting the pistons 18, the upper bending jaw 8 is provided at its longitudinal edge 21 with a connecting strip 21'. The cylinders 20 have advantageously only minimal spacing from one another so that as a result of the short bending lengths located between the neighboring cylinders 20 only a minimal bending of the bending bar 7 occurs, even under high load. The bending jaw 7 can therefore be of a very slim and space-conserving configuration. It can have, in particular, a great length without an impermissibly high bending of the bending jaw 7 having to be feared even for a slim configuration.

Figure 2:
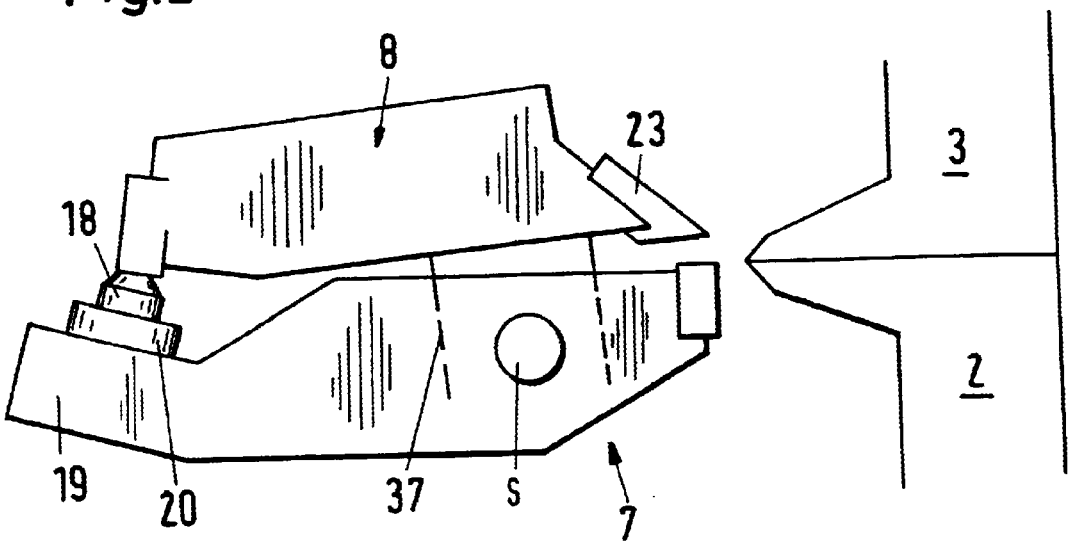
FIG. 2 the bending jaws of FIG. 1 in an enlarged illustration wherein the upper bending jaw is pivotably supported on the lower bending jaw.

The bending jaw 8 has substantially a trapezoidal cross-section with a V-shaped, projecting forward edge 22 facing the bending machine 2, 3 on which a bending strip 23 is fastened (FIGS. 1 and 2).

The lower bending jaw 7 has approximately a rectangular cross-section and comprises the projection 19 that is strip-shaped and points away from the clamping tools 2, 3 and whose top side adjoins an edge 24 that is slantedly upwardly positioned and extends in the direction toward the clamping tools 2, 3. The bending jaw 7 has at its end face 26 facing the bending machine a bending strip 27 on which, during the bending process, rests a leg 34 (FIG. 4) of a V-shaped bending section 36 of the sheet metal part 41 to be bent. The bending strip 27 has a rectangular cross-section while the other bending strip 23 has a substantially trapezoidal cross-section. With its lower side surface 28 the upper bending strip 23 is positioned, with interposition of the fold, on an upper narrow side 29 of the bending strip 27 when the two bending jaws 7, 8 are closed. Below the strip 27 the bending jaw 7 has a slanted wall section 30 extending away from the clamping tools 2, 3 downwardly and to the rear.

Figure 4:
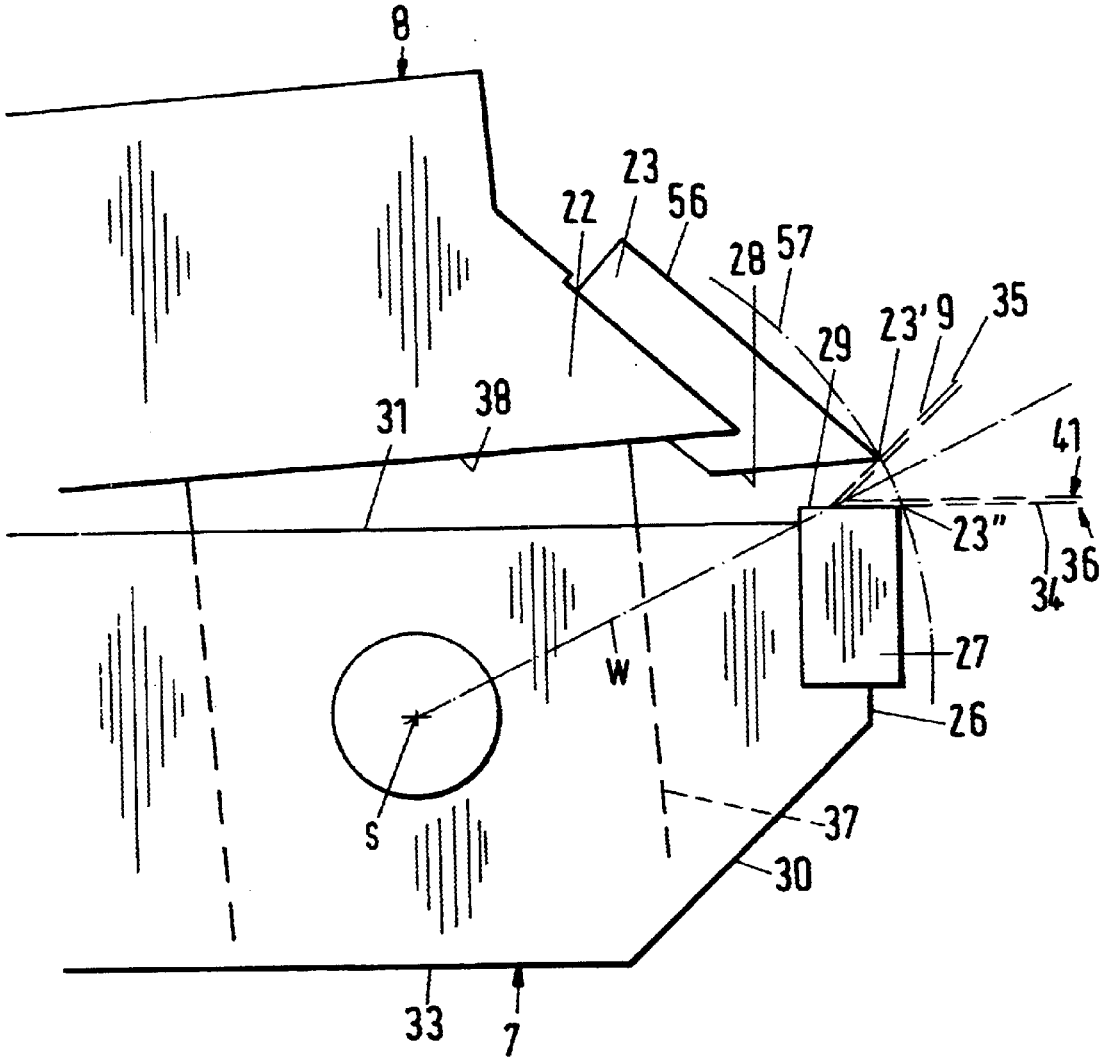
FIG. 4 a detail of the bending jaws according to FIG. 2.
Figure 5:
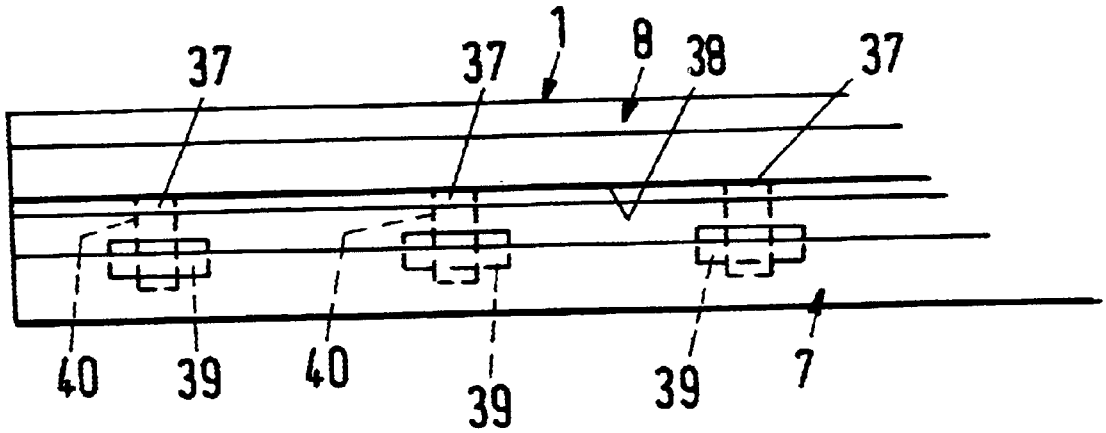
FIG. 5 of view in the direction of arrow V in FIG. 1.
Figure 6:
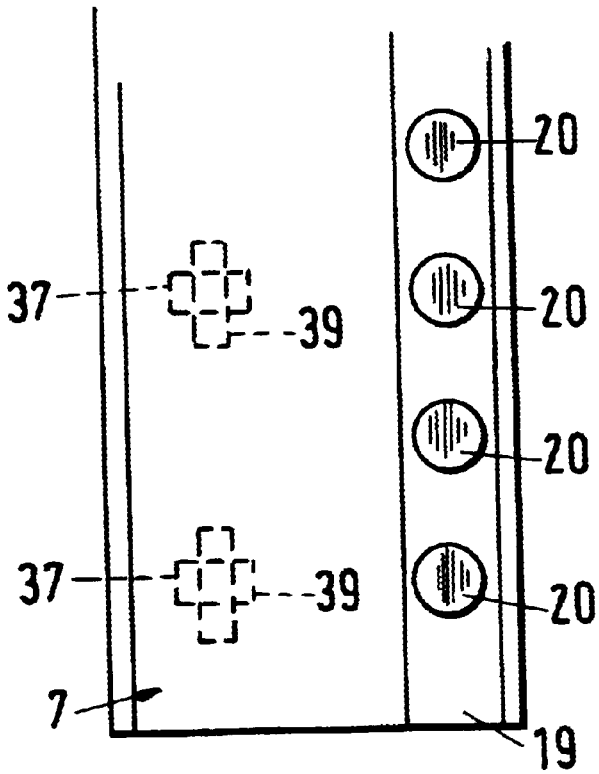
FIG. 6 of view in the direction of arrow VI in FIG. 1 onto the lower bending jaw.

As is shown in FIGS. 4, 5, and 6, the bending jaw 8 is pivotably arranged about an imaginary axis S extending through the bending jaw 7. The axis S is positioned approximately at half the width between the underside 33 and the top side 31 facing the upper bending jaw 8. The pivot axis S is positioned in the half of the lower bending jaw 7 facing the bending machine 2, 3.

The pivot axis is positioned such that during the folding process no relative movement can take place between the strip 23 and the sheet metal portion 9, which rests against the strip 23. Accordingly, scratches, marks and the like on the sheet metal portion 9 are reliably prevented. FIG. 4 shows the upper bending jaw 8 in its initial position before the folding process. The edge 23' positioned between the side surface 28 and the end face 56 extending at an acute angle thereto moves during the folding process along a circular arc 57 about the pivot axis S until it comes to rest against the location 23" toward the end of the folding process. The pivot axis S is positioned such that it is located on the bisecting line W between the initial and end points 23' and 23". This position of the pivot axis S has not only the advantage that scratches, marks and the like are avoided but also that the effective leverage during the folding process is constant and that a constant bending or pressure force is thus exerted.

As is illustrated in FIGS. 5, 6, and 6*a*, the pivotable bending jaw 8 has in its longitudinal direction several bearing parts 37 of a parallelepipedal shape positioned successively and at a spacing to one another which project past the underside 38 of the bending jaw and project into depressions 58 in the top side 31 of the lower bending jaw 7 (FIG. 6*a*). The narrow sides 40 of the upright bearing parts 37 extend in the longitudinal direction of the bending jaw 8. The bearing parts 37 are advantageously detachable connected on the upper bending jaw 8 so that they can be easily exchanged if needed. Within the depressions 58 the bearing parts 37 are penetrated by axles 39 which project into openings in the sidewalls of the depressions 58 and are secured therein against rotation. The axles 39 extend in the longitudinal direction of the lower bending jaw 7 and perpendicularly to the wide sides of the bearing parts 37 which are seated on the axles 39 so as to be rotatable. The width of the depressions 58 corresponds to the thickness of the bearing parts 37 so that they cannot be moved on the axles 39. The respective depression 58 is longer than the respective bearing parts 37 in a direction perpendicular to the axles 39 so that the bending jaw 8 can perform the pivot movement required for the folding process. The center lines of the axles 39, which are aligned with one another, form the pivot axis S.

Figure 3:
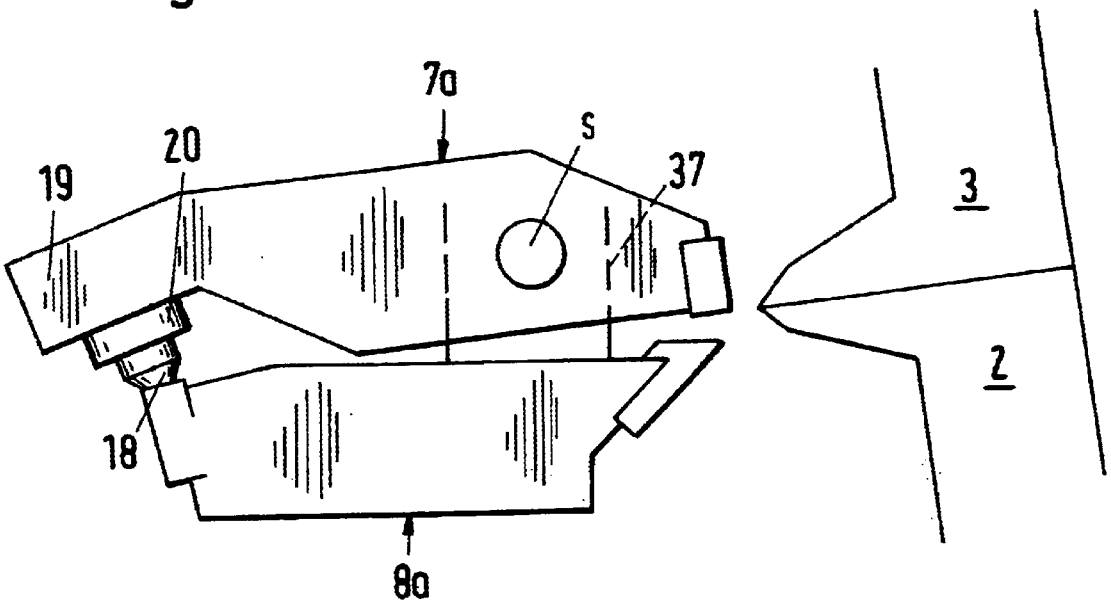
FIG. 3 an illustration according to FIG. 2, however, with a mirror-symmetrical configuration in comparison to the arrangement of FIG. 2.
Figure 7:
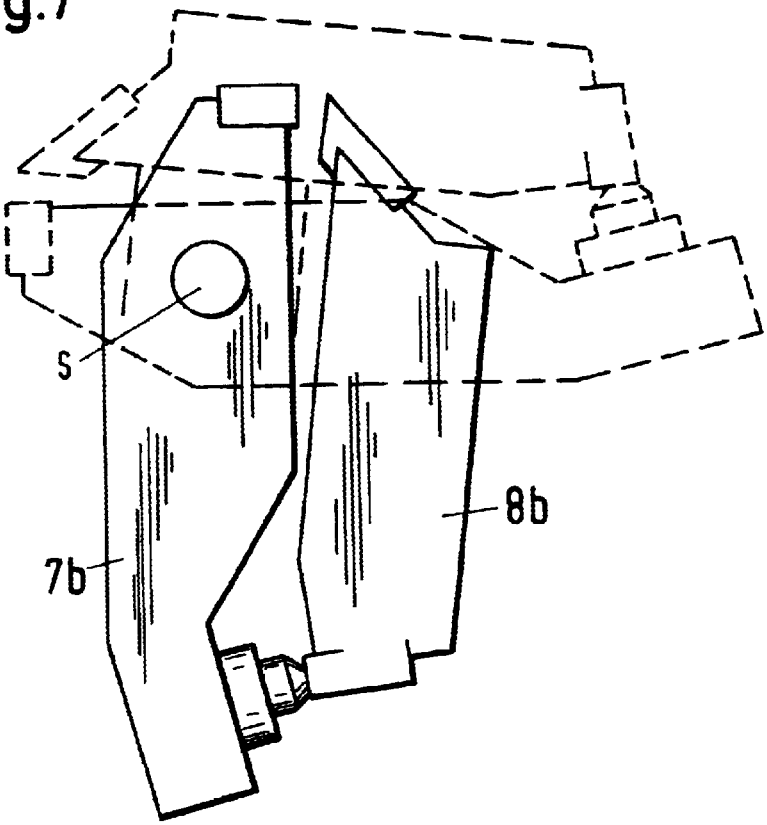
FIG. 7 the bending jaw of FIG. 2 in a position pivoted by 90° in which position the bending jaw extends approximately vertically.

The embodiment according to FIG. 3 differs from the above described embodiment only in that the pivotable bending jaw 8*a* is located below the fixedly arranged bending jaw 7*a*. Accordingly, the pivot axis S is in the area above the bending jaw 8*a*. In other respects, this bending tool corresponds to the bending tool according to FIG. 1. FIG. 7 shows an embodiment in which the bending jaws 7*b*, 8*b* are connected with both ends to a rotary support (not illustrated), such as a turntable. The two rotary supports are rotatable about an axis extending parallel to the pivot axis S on the carriage 6. In FIG. 7 the solid and dashed lines show two different positions of the bending jaws 7*b*, 8*b*. In the illustrated embodiment, the rotational axis of the rotary support coincides with the pivot axis S. For rotation of the rotary support, the carriage 6 (FIG. 1) is provided with a rotary drive (not illustrated). With it, the bending jaws 7*b*, 8*b* can be advantageously brought into any desired rotational position. It is, of course, possible to configure the rotary drive such that only certain angular positions of the bending jaws 7*b*, 8*b* can be adjusted. In other respects, this embodiment is also identical to that according to FIG. 1.

Figure 8:
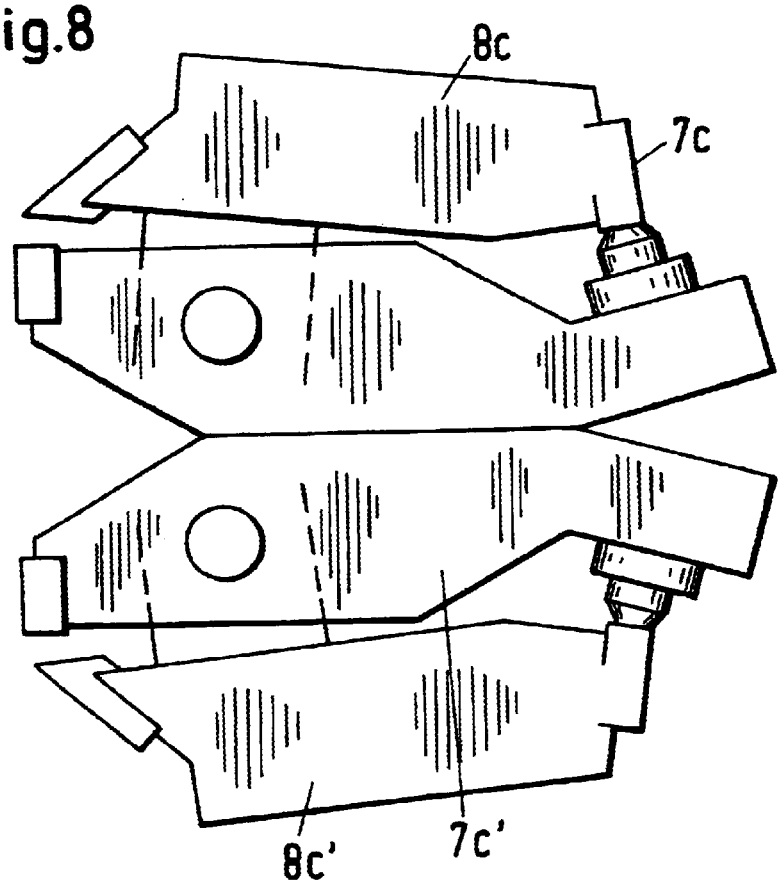
FIG. 8 two bending tools arranged mirror-symmetrically to one another with two bending jaws, respectively, corresponding to FIG. 2.

The bending device according to FIG. 8 is comprised of two identical bending jaws 7*c*, 8*c* and 7*c'*, 8*c'* which are configured corresponding to the embodiment according to FIG. 1 but arranged mirror-symmetrical to one another. In this connection, the stationary bending jaws 7*c*, 7*c'* are connected fixedly with one another while the pivotable bending jaws 8*c*, 8*c'* are arranged at the bottom and the top of the tool. In other respects, these bending jaws 7*c*, 7*c'* and 8*c*, 8*c'* are identical to the bending jaws 7 and 8 according to FIG. 1. This tool can also be embodied to be adjustable, like the tool of FIG. 7, by means of rotary supports into different rotational positions.

FIGS. 9 through 13 show, respectively, bending processes which can be carried out with the afore describe bending tools.

Figure 9:
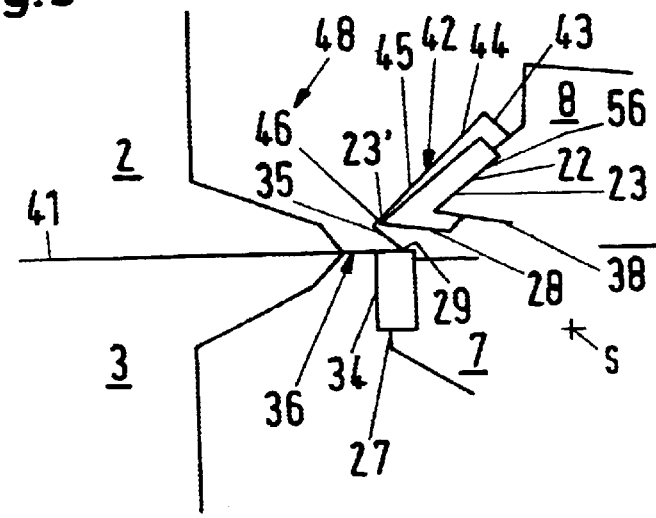
FIG. 9 in a schematic illustration the device according to the invention of FIG. 1 or FIG. 2 before the bending process.

FIG. 9 shows a bent portion 42 of a sheet metal plate 41 bent on a conventional bending machine which plate is clamped between the clamping tools 2 and 3 of the bending machine. The sheet metal plate 41 is transported after the bending process in the direction of the bending device with the bending jaws 7, 8. For this purpose, the transport device of the bending machine is used. In the position illustrated in FIG. 9, the sheet metal plate 41 is clamped in the undeformed area by means of the clamping tools 2, 3 for the subsequent folding process. The edge portion 42 has a U-shaped end portion 43, 44, 35 with a transverse stay 44 and the legs 35, 43 extending at a right angle thereto. The leg 35 forms one leg of the V-shaped bent portion 36 according to FIG. 4. The described bent portions have been produced in the bending machine.

Figure 9A:
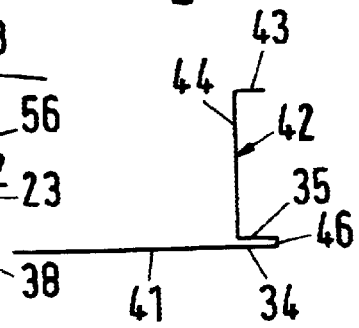
FIG. 9*a* the sheet metal part finish-bent by the device according to the invention.

Now the V-shaped bent portion 36 is bent to a fold 46 by the bending device wherein the bent leg 35 rests against the leg 34 (FIG. 9*a*).

The bending jaw 8 is first pivoted back so that the V-shaped bent portion 36 projects into a gap 45 between the two bending jaws 7, 8. Since the bending device with the support 5 can be moved against the bending machine, the bending jaws 7, 8 can be adjusted simply and precisely with regard to their working position. Moreover, by means of the carriage 6 a precise height adjustment of the bending jaws 7, 8 relative to the bent section 36 is ensured. The bending jaws 7, 8 are adjusted such that the bending edge 23' of the bending strip 23 rests against an edge 46 between the transverse stay 44 and the leg 35 of the edge portion 42. Since the end face 56 and the side surface 28 of the bending strip 23 are positioned at an acute angle to one another, the transverse stay 44 and the leg 35 of the edge portion 42 have a spacing from the end face 56 and the side surface 28 of the bending strip 23. Since the bending strip 23 is placed onto a correspondingly shaped end face area of the bending jaw 8, the bending strip 23 projects past the corresponding sides 22, 38 of the bending jaw 8 which are positioned at an acute angle to one another. Accordingly, a free space for the end leg 43 of the edge portion 42 is formed. In addition, it is possible to provide at the end face 22 of the bending jaw 8 adjacent to the bending strip 23 a recessed area so that the end leg 43 during the folding process will not come into contact with the bending jaw 8.

During the folding process the sheet metal plate 41 or the V-shaped bent section 36 is positioned with the leg 35 on the plane upper side 29 of the bending strip 27 of the bending jaw 7. The upper bending jaw 8 is pivoted in the direction of the arrow 48 in a counter-clockwise direction. For this purpose, all cylinders 20 are actuated simultaneously. With the extended pistons 18 the bending jaw 8 is pivoted about the axis S. In this context, the bearing parts 37 pivot about the bearing axles 39 in the direction toward the bending jaw 7. By means of the bending strip 23 the upper leg 35 of the bent portion 36 is bent downwardly into the position illustrated in FIG. 9*a* in which it rests against the lower leg 34.

The bending tool 7, 8 serves in the described bending process as folding pliers with which such folds 46 can be reliably formed in a simple way at a spacing from the free edge of the sheet metal plate 41. The edge portion 42, respectively, its transverse stay 44 adjoins the fold 46 so as to extend perpendicularly upwardly.

Figure 10:
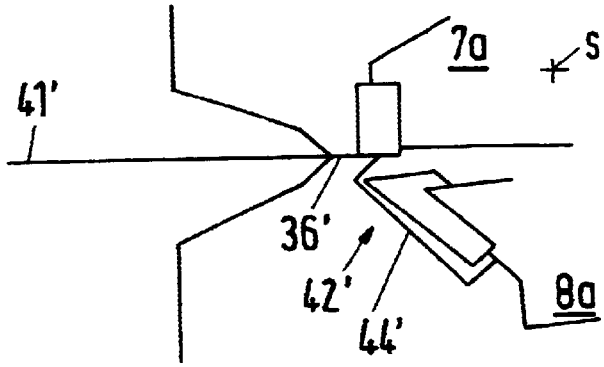
FIG. 10 in a schematic illustration the device according to the invention of FIG. 2 before the bending process.
Figure 10A:
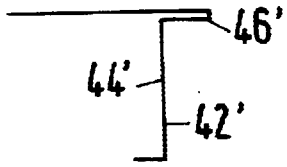
FIG. 10*a* the sheet metal bent by the bending device according to FIG. 10.

The bending process according to FIG. 10 differs from the afore described bending process only in that the edge portion 42' with its V-shaped bent portion 36' extends downwardly. Accordingly, for folding the portion 36', the bending tool 7*a*, 8*a* according to FIG. 8*a* is used. In other respects, the folding process is carried out according to the above described process wherein the lower bending jaw 8*a* is pivoted about the axis S against the bending jaw 7*a* positioned above. This results in the fold 46' from which the edge portion 42' or its transverse stay 44'projects perpendicularly downwardly.

Figure 11:
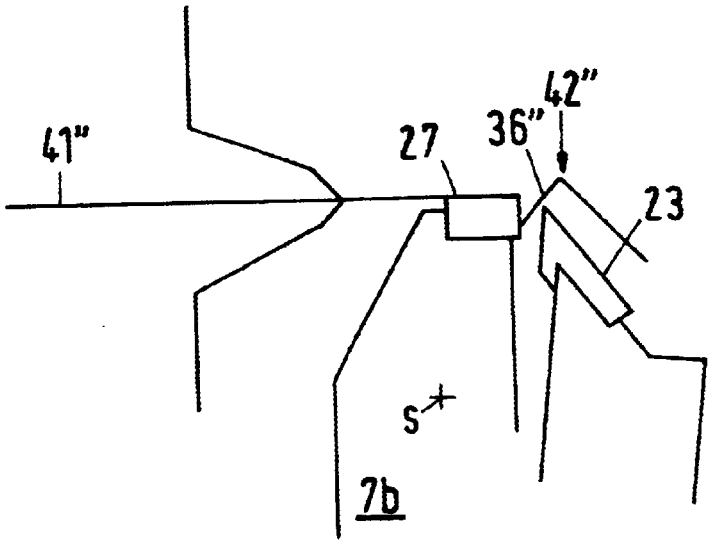
FIG. 11 in a schematic illustration the device according to the invention of FIG. 7 before the bending process.
Figure 11A:
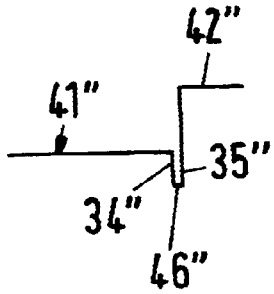
FIG. 11*a* the sheet metal part bent by the bending device according to FIG. 11.

During the folding process according to FIGS. 9 and 10, the fold 46, 46' is positioned in the sheet metal plane. FIGS. 11 and 11*a* show the possibility to produce the fold 46" in such a way on the sheet metal plate 41" that it is perpendicular thereto. The bending jaws 7*b*, 8*b* in this case are rotated by means of the rotary support into the position illustrated in solid lines in FIG. 7.

For folding the V-shaped bent portion 36" the bending jaw 8*b* is pivoted about the axis S of the bending jaw 7*b* in a counter-clockwise direction so that the leg 35" is forced against the leg 34". As in the above described folding processes, the legs 34", 35" are compressed between the bending strips 23, 27. In contrast to the previous embodiments, an L-shaped edge portion 42" adjoins the fold 46". The fold 46" adjoins the sheet metal plate 41" at a right angle.

Finally, in FIGS. 12, 12*a*, and 12*b* as well as in 13 , 13*a* and 13*b* two further folding possibilities for producing sheet metal plate edges are illustrated resulting in folds that are positioned at a spacing from the sheet metal plane.

In the embodiment according to FIGS. 12, 12*a*, 12*b*, the edge portion 49 of the sheet metal plate 54 has been bent by the bending machine 2, 3 such that first an L-shaped end portion 50 is formed which has a transition via a V-shaped bent portion 51 into a straight portion 53 which adjoins at a right angle the area of the sheet metal plate 54 which is not deformed. The portion 53 extends from the sheet metal plate 54 perpendicularly upwardly so that the V-shaped bent portion 51 is positioned at a spacing above the sheet metal plane. By means of the two bending jaws 7, 8, the two legs of the bent portion 51 are compressed in the described way to the fold 46'". An edge profile 49' results after folding, as illustrated in FIG. 12*a*.

After opening of the bending tools 7, 8, the bending device is returned so that the edge profile 49' is exposed. In the same or in a different bending machine, a further bending process can then be performed in a conventional way. For this purpose, section 55 of the sheet metal plate 54 is bent perpendicularly upwardly. The fold 46'" is therefore no longer parallel but perpendicular to the sheet metal plane (FIG. 12*b*).

In the embodiment of FIGS. 13, 13*a*, and 13*b*, the same procedure is carried out with the difference that the edge portion 49*a* is mirror-symmetrically bent downwardly relative to that of FIG. 12. For folding the V-shaped bent portion 51*a*, the bending tool 7*a*, 8*a* according to FIG. 3 or 10 is used with which, after folding, the edge profile 49*a'* is formed. This edge portion 49*a'* can also be bent in a further bending process on a conventional bending machine so that the fold 46'" is positioned perpendicularly to the sheet metal plane. The plane section 55*a* adjoins at a right angle downwardly the sheet metal plate 54*a*.

The described bending devices according to FIGS. 1 through 13, respectively, their bending tools 7, 8, 7*a*, 8*a*, 7*b*, 8*b*, 7*c*, 8*c*, 7*c'*, 8*c'* are suitable for use in conventional bending machines. The bending devices can be retrofitted any time without problem on a bending machine. It is also possible to use the bending devices as independent machines so that they can be used independently for folding edges of sheet metal plates and the like.

In the illustrated and described embodiments only one fold has been produced, respectively. Since the bending jaws can be adjusted by means of the support 5 and the carriage 6 in the horizontal and vertical directions, it is possible to produce two and more folds on a sheet metal plate at a spacing from its free edge.

What is claimed is:

1. A bending device comprising:

one or more bending tools, each bending tool having one or more adjustable bending jaws and one or more stationary bending jaws configured to produce a fold on a sheet metal plate wherein the adjustable bending jaw is pivotably supported on the stationary bending jaw so as to be pivotable about a pivot axis;

at least one joint connecting the adjustable bending jaw and the stationary bending jaw to one another;

at least one adjusting device engaging the adjustable bending jaw;

wherein the adjusting device is a pressure cylinder.

2. The device according to claim 1, wherein the pivot axis of the adjustable bending jaw is located within the stationary bending jaw.

3. The device according to claim 1, wherein the adjustable and stationary bending jaws have end faces and comprise bending strips arranged in the area of the end faces, wherein the bending strips in an initial position of the adjustable and stationary bending jaws delimit an opening angle having a bisecting line intercepting the pivot axis.

4. The device according to claim 1, wherein the adjusting device is arranged in the area of the at least one joint.

5. The device according to claim 1, wherein several of the adjusting devices are provided so as to engage the adjustable bending jaw and are arranged successively at a spacing to one another across a length of the adjustable bending jaw.

6. The device according to claim 1, wherein the adjusting device is supported on the stationary bending jaw.

7. The device according to claim 1, wherein the adjustable bending jaw has at least one bearing part and is supported with the at least one bearing part in the stationary bending jaw.

8. The device according to claim 7, wherein across a length of the pivotable bending jaw several of the bearing parts are provided spaced at a distance from one another.

9. The device according to claim 7, wherein the stationary bending jaw has at least one bearing axle projecting through the at least one bearing part of the adjustable bending jaw.

10. The device according to claim 9, wherein the at least one bearing part is seated rotatably on the at least one bearing axle.

11. The device according to claim 9, wherein the at least one bearing part is arranged axially fixedly on the at least one bearing axle.

12. A bending device comprising:

one or more bending tools, each bending tool having one or more adjustable bending jaws and one or more stationery bending jaws configured to produces a fold on a sheet metal plate, wherein the adjustable bending jaw is pivotably supported on the stationary bending jaw so as to be pivotable about a pivot axis;

at least one joint connecting the adjustable bending jaw and the stationary bending jaw to one another;

at least one adjusting device engaging the adjustable bending jaw;

wherein the adjusting device has a piston connected pivotably to the adjustable bending jaw.

13. A bending device comprising:

one or more bending tools, each bending tool having one or more adjustable bending jaws and one or more stationary bending jaws configured to produce a fold on a sheet metal plate, wherein the adjustable bending jaw is pivotably supported on the stationary bending jaw so as to be pivotable about a pivot axis;

wherein the adjustable bending jaw has at least one bearing part and is supported with the at least one bearing part in the stationary bending jaw;

wherein the stationary bending jaw has at least one bearing axle projecting through the at least one bearing part of the adjustable bending jaw;

wherein the stationary bending jaw has at least one depression and the at least one bearing part projects into the at least one depression.

14. The device according to claim 13, wherein the width of the at least one depression measured in an axial direction of the bearing axle matches a width of the at least one bearing part.

15. A bending device comprising:

one or more bending tools, each bending tool having one or more adjustable bending jaws and one or more stationary bending jaws configured to produce a fold on a sheet metal plate, wherein the adjustable bending jaw is pivotably supported on the stationary bending jaw so as to be pivotable about a pivot axis; and a carriage configured to provide height adjustment for the adjustable and stationary bending jaws.

16. The device according to claim 15, wherein the carriage comprises a spindle drive for height adjustment.

17. The device according to claim 15, further comprising a support, wherein the carriage is arranged on the support.

18. The device according to claim 17, wherein the support is movable horizontally.

19. The device according to claim 15, wherein the bending tool is rotatably supported on the carriage.

20. The device according to claim 15, wherein two of the bending tools are arranged on the carriage.

21. The device according to claim 20, wherein the two bending tools are arranged mirror-symmetrically to one another.

22. The device according to claim 21, wherein the stationary bending jaws of the two bending tools are fixedly connected to one another.

* * * * *